US006751869B2

(12) United States Patent
Paggeot

(10) Patent No.: US 6,751,869 B2
(45) Date of Patent: Jun. 22, 2004

(54) SKIRTED FLOOR SCRAPER BLADE

(76) Inventor: Patrick W. Paggeot, 3040 W. Vande Loo, Tucson, AZ (US) 85746

( * ) Notice: Subject to any disclaimer, the term of this patent is extended or adjusted under 35 U.S.C. 154(b) by 0 days.

(21) Appl. No.: 10/193,125

(22) Filed: Jul. 12, 2002

(65) Prior Publication Data

US 2004/0006875 A1 Jan. 15, 2004

(51) Int. Cl.[7] ..... A47L 13/08
(52) U.S. Cl. ..... 30/169; 15/236.01
(58) Field of Search ..... 30/169, 171, 172, 30/357, 349, 329, 167, 168, 346; 15/236.01, 236.02, 236.07, 236.09; D32/46, 48

(56) References Cited

U.S. PATENT DOCUMENTS

| | | | | | |
|---|---|---|---|---|---|
| 323,502 | A | | 8/1885 | Edwards | 30/169 |
| 358,234 | A | * | 2/1887 | Vache | 15/236.01 |
| 1,529,683 | A | * | 3/1925 | Anderson | 30/167 |
| 1,898,690 | A | * | 2/1933 | Schacht | 15/236.01 |
| 1,927,202 | A | * | 9/1933 | Burdick | 30/169 |
| 2,268,393 | A | | 12/1941 | Hanssen | 30/171 |
| 3,035,344 | A | | 5/1962 | Brown | 30/346 |
| 4,089,562 | A | * | 5/1978 | Baumeister | 30/168 |
| D366,130 | S | * | 1/1996 | Ordonez | D32/46 |
| 5,924,204 | A | | 7/1999 | Lane | 30/169 |
| 6,237,225 | B1 | | 5/2001 | Tarrant | 30/169 |
| 6,519,801 | B1 | * | 2/2003 | Chao | 15/236.01 |

* cited by examiner

*Primary Examiner*—Hwei-Siu Payer
(74) *Attorney, Agent, or Firm*—Richard C. Litman

(57) ABSTRACT

A scraper blade for fitting into a gripper such as a mounting, holding, or clamping device of a scraper. The inventive scraper blade is particularly useful with a floor scraper. The inventive scraper blade has a beveled edge portion, a flat portion, a skirt portion extending outward from the flat portion, and a shank portion fitting into a gripper of a scraper apparatus. The skirt portion has a generally vertical rear side which preferably rests against the nose of the gripper. A flat shank portion extends rearward from the rear side of the skirt portion and serves as the gripping surface of the blade for the gripper of the scraper apparatus. Dislodged material travels over the beveled edge portion, then over the flat portion, and then directed upward over the skirt portion and then over the nose of the gripper avoiding jamming at the gripper nose.

16 Claims, 4 Drawing Sheets

SKIRTED FLOOR SCRAPER BLADE

BACKGROUND OF THE INVENTION

1. Field of the Invention

The present invention relates to a blade useful in a scraper or knife. More particularly, the present invention relates to a blade having a skirt spaced from the edge.

2. Description of the Related Art

The use of scrapers for removing paint, tile, wall paper, and similar coverings from a floor or wall is well known. A drawback in such scrapers is that material collects at the intersection of the scraper blade and the nose of the blade gripper. This reduces the effectiveness of the scraper and shortens the effective scraping stroke. Material may become lodged between the shank of the blade of the scraper and the gripper, causing undesired deformation of the gripper blade resulting in gouging of the surface being cleaned. The shorter strokes and added resistance to scraping as material builds up on the nose of the gripper, particularly in floor scrapers, results in less useful life of the scraper handle. Also, time is lost in removing material collected on the nose of the gripper and material jammed between the gripper and the shank of the scraper blade.

It would be desirable to provide a scraper blade which allows the removed material to travel over the nose of the blade gripper, thus avoiding the jamming of removed material between the gripper and the blade. It would, also, be desirable to provide such a scraper blade which is so configured as to be repeatedly sharpened without effecting the overall shape and function of the blade.

U.S. Pat. No. 5,924,204, issued Jul. 20, 1999, to Lane describes a scraper having a wedge-shaped blade to avoid material from building up or being jammed against the nose of the gripper and between the nose of the blade gripper and the blade. Removed material travels up over the wedge and continues over the gripper, thus avoiding buildups of material against the gripper nose. The present invention provides a flat portion between the beveled blade edge and the wedge-shaped skirt allowing the beveled blade to be sharpened repeatedly without changing the angle of the bevel or the height of the skirt. This would not be possible in the '204 blade without removing the blade and reducing the overall height of the wedge, thus exposing the gripper nose to material buildups.

U.S. Pat. No. 3,035,344, issued May 22, 1962, to E. G. Brown describes a knife with stripped inclined surfaces rising up from the sharp edge of the blade.

U.S. Pat. No. 6,237,225 B1, issued May 29, 2001, to Tarrant describes a floor scraper useful for removing vinyl tile or floor covering from floors.

U.S. Pat. No. 323,502, issued Aug. 4, 1885, to Edwards, describes a scraper having an inclined edge portion.

U.S. Pat. No. 2,268,393, issued Dec. 30, 1941, to Hanssen, describes a hand-held floor scraper.

None of the above inventions and patents, taken either singularly or in combination, is seen to describe the instant invention as claimed. Thus a skirted floor scraper blade solving the aforementioned problems is desired.

SUMMARY OF THE INVENTION

The present invention is a scraper blade for fitting into a gripper such as a mounting, holding, or clamping device of a scraper. The inventive scraper blade is particularly useful with a floor scraper. The inventive scraper blade has a beveled edge portion, a flat portion, a skirt portion extending outward from the flat portion, and a shank portion fitting into a gripper of a scraper apparatus. The skirt portion has a generally vertical rear side which preferably rests against the nose of the gripper. A flat shank portion extends rearward from the rear side of the skirt portion and serves as the gripping surface of the blade for the gripper of the scraper apparatus.

Material dislodged by the edge of the blade travels over the beveled edge portion, then over the flat portion, and then is directed upward over the skirt portion and then over the nose of the gripper. This avoids the accumulating and jamming of dislodged material between the scraper and the gripper, allowing longer strokes when cutting or scraping, less wear and tear on the gripping apparatus, a longer lasting blade due to its inherent heavy duty construction, and the avoidance of bending or warping the blade gripping device which results in the blade falling out of the gripper during the scraping operation.

Accordingly, it is a principal object of the invention to provide a blade for a scraper which prevents the accumulation of removed material between the scraper blade and the gripper of a scraper apparatus.

It is another object of the invention to provide a blade as above which directs removed material over the nose of the gripper of the scraper apparatus.

It is a further object of the invention to provide a blade as above which may be repeatedly sharpened without changing the angle of the scraper cutting edge.

Still another object of the invention is to provide a blade as above which is useful as a knife blade for a variety of purposes where the blade is mounted in a mounting device to direct material or debris to flow over the mounting, holding, or clamping device.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a scraper blade for fitting into a gripper such as a mounting, holding, or clamping device of a scraper. The inventive scraper blade is particularly useful with a floor scraper. The inventive scraper blade has a beveled edge portion, a flat portion, a skirt portion extending outward from the flat portion, and a shank portion fitting into a gripper of a scraper apparatus. The skirt portion has a generally vertical rear side which preferably rests against the nose of the gripper. A flat shank portion extends rearward from the rear side of the skirt portion and serves as the gripping surface of the blade for the gripper of the scraper apparatus.

Material dislodged by the blade edge travels over the beveled edge portion, then over the flat portion, and then is directed upward over the skirt portion and then over the nose of the gripper. This avoids the accumulating and jamming of dislodged material between the scraper and the gripper, allowing longer strokes when cutting or scraping, less wear and tear on the gripping apparatus, a longer lasting blade due to its inherent heavy duty construction, and the avoidance of bending or warping the blade gripping device which results in the blade falling out of the gripper during the scraping operation.

Figure 1:
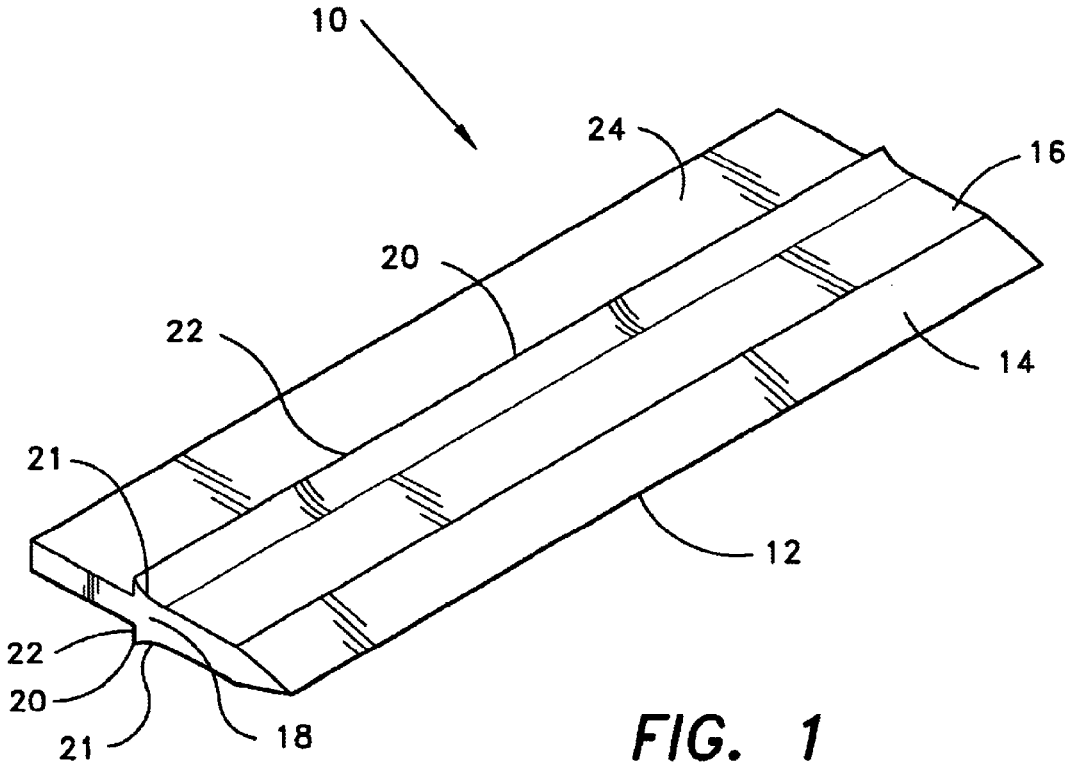
FIG. 1 is a perspective view of the skirted floor scraper or knife blade according to the present invention.
Figure 2:
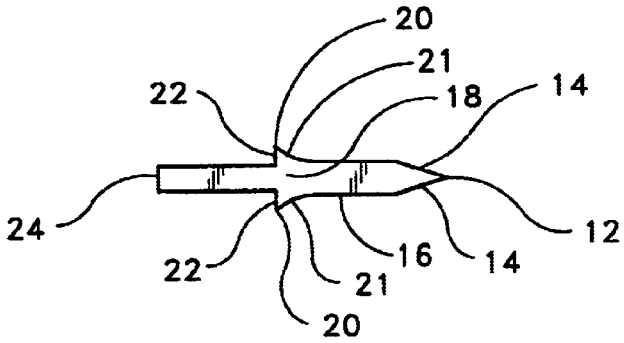
FIG. 2 is an elevational side view of the scraper or knife blade of FIG. 1.
Figure 3:
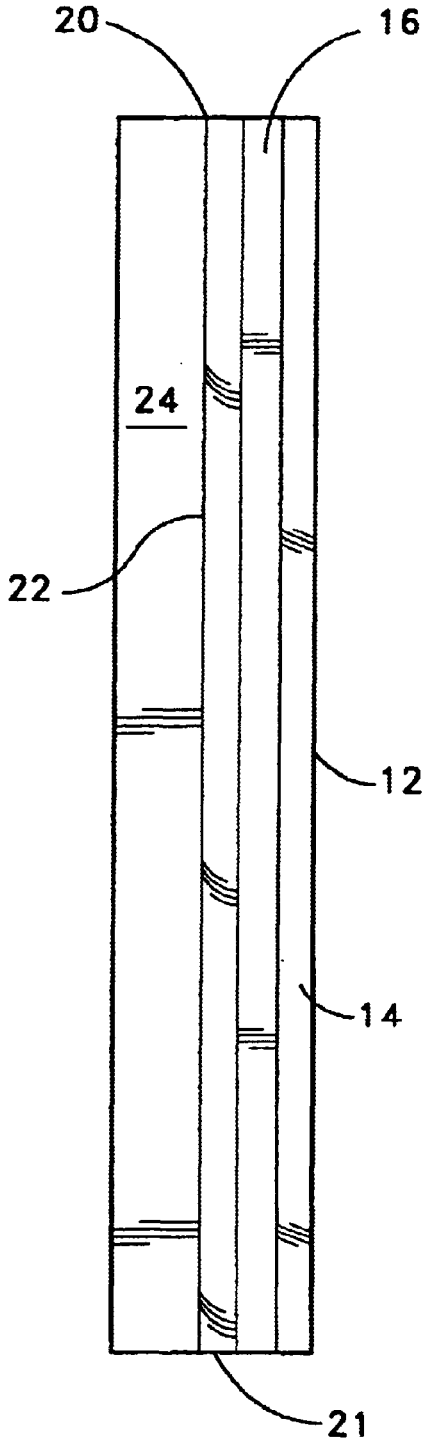
FIG. 3 is a plan view of the scraper or knife blade of FIG. 1.

Referring to FIGS. 1, 2, and 3, there is shown a perspective view, a side view in elevation, and a plan view, respectively, of the knife or scraper blade of the present invention. Blade 10 has a cutting edge 12 of edge bevels 14. Edge bevels 14 extend from blade flat portion 16 which leads to skirt portion 18, having upper and lower skirts 20. Skirts 20 are generally wedge shaped, having a concave inclined surface 21 and a vertical rear wall 22. A shank portion 24 extends from the skirt portion for insertion into a mounting, holding or clamping device.

Figure 4:
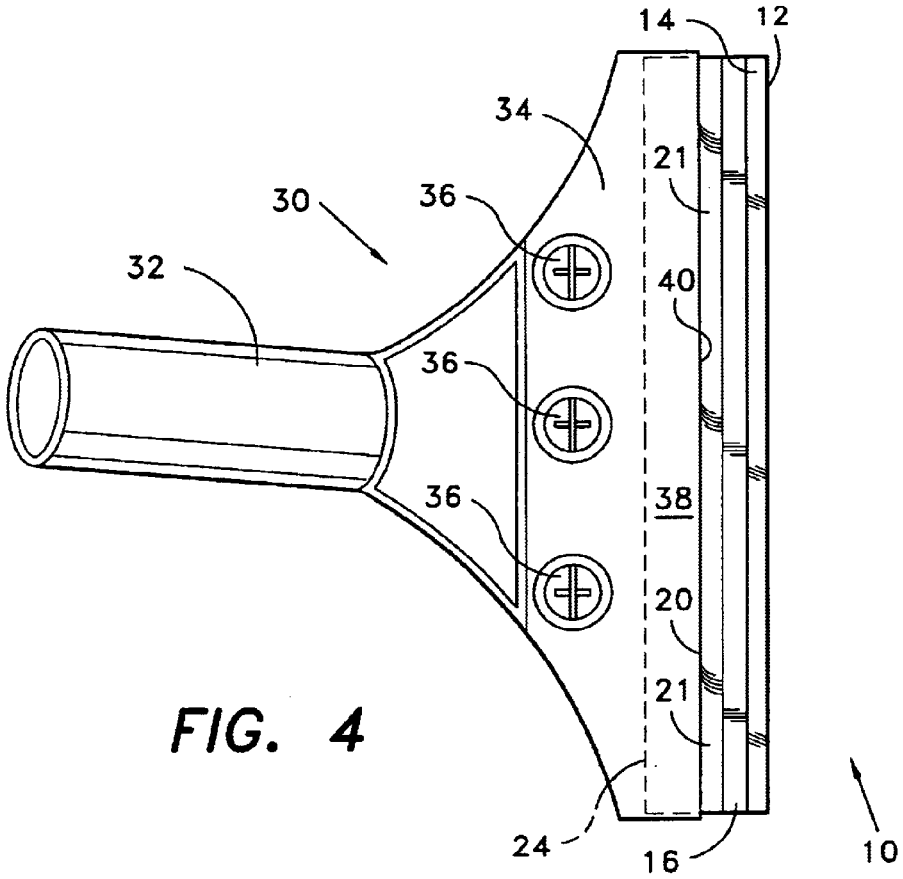
FIG. 4 is a top view of a standard scraper blade holder with the inventive blade of FIG. 1.
Figure 5:
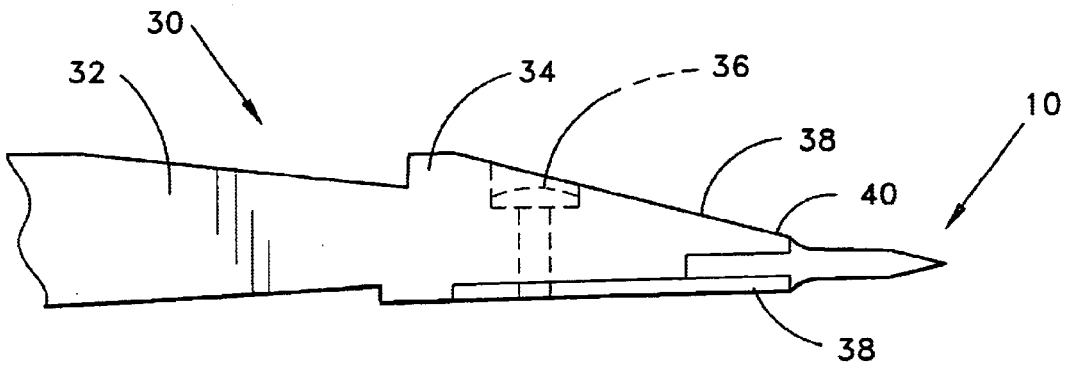
FIG. 5 is a side view of the scraper and blade of FIG. 4.

Referring to FIGS. 4 and 5, there is shown a plan view and a side elevation view, respectively, of a floor scraper 30 having a handle 32 connected with a blade holder body 34. The adjustment of blade gripper screws 36 adjust tension on blade gripper portion 38 to hold or release the inventive blade 10. Blade gripper portion 38 has a gripper nose 40 where the shank 24 of blade 10 is inserted up to the rear walls of skirts 20.

Figure 6:
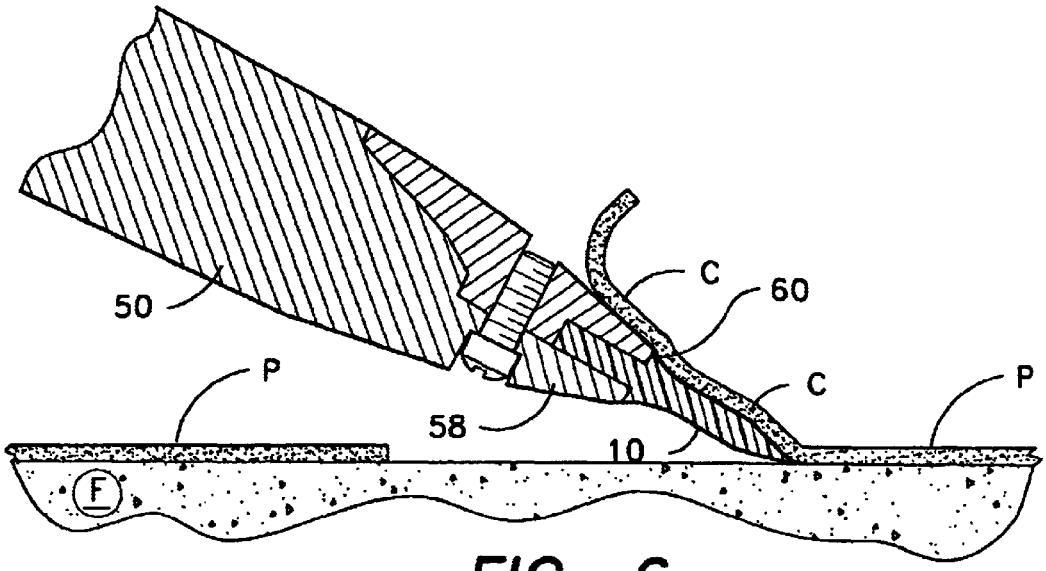
FIG. 6 is a sectional side view of a hand-held scraper blade holder with the scraper blade of the present invention installed.
Figure 7:
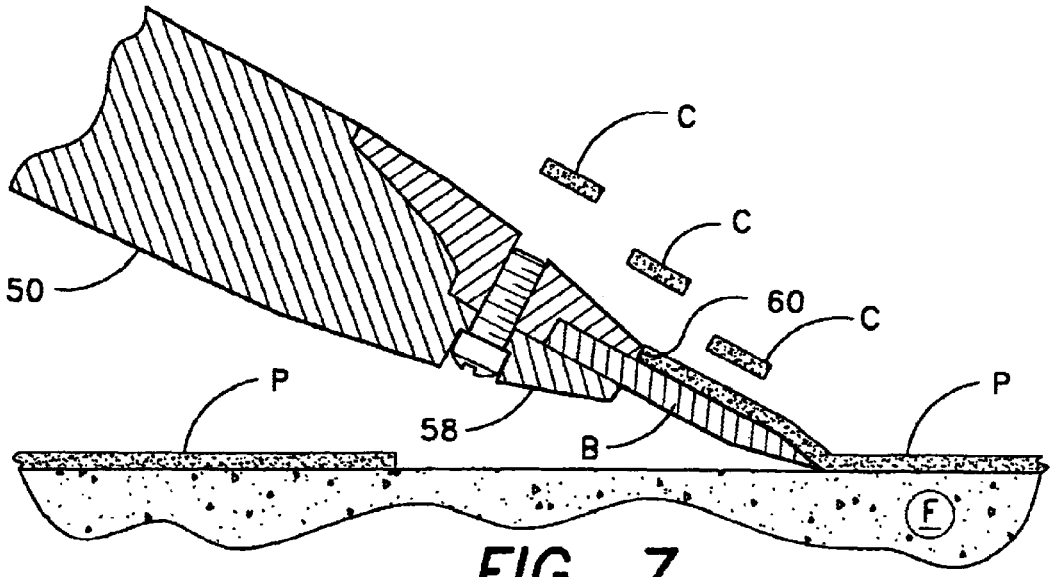
FIG. 7 (PRIOR ART)
FIG. 7 is a sectional side view of a scraper blade holder of FIG. 6 with a prior art scraper blade installed.

Referring to FIGS. 6 and 7, there is shown a side view of a hand-held floor scraper 50 with the scraper blade 10 of the present invention installed, and side view of a the same scraper blade holder 50 with a prior art scraper blade B installed. As is illustrated, paint P is being removed from floor F by floor scrapers 50 having blade grippers 58 with the inventive blade 10 and the prior art blade B installed through gripper noses 60 and held by their shanks in respective gripper portions 58. As is illustrated, as the scrapers 50 are urged forward, the paint chips C are removed by the edge of the respective blades and travel over the bevels to the flat portion of the blades. As seen in FIG. 7, the prior art blade B simply extends upward through gripper nose 60 into gripper 58, allowing chips C to jam against the nose 60 of gripper portion 58. As is seen in FIG. 6, the paint chips C travel over the bevels and the flat portion of the inventive blade 10 where they are diverted upward by the skirts so as to travel over gripper portion 58 without jamming into the gripper nose 60.

A preferred embodiment of the inventive knife or scraper blade has a flat portion and said shank portion of 1/16 inch in thickness and the distance between the upper and lower skirt extremes is 1/8 inch. The inventive knife or scraper blade has a beveled edge portion of 1/8 inch in width, a flat portion of 1/8 inch in width, a skirt portion of 1/8 inch in width, and a shank portion of 1/4 inch in width, the overall blade totaling about 5/8 inch in width.

The inventive knife or scraper blade is useful in a variety of industries including flooring, construction, paper mills, saw mills, manufacturing, processing and hazardous material removal. The blade may be of any length desired including 3 inch, 4 inch, 5 inch, 8 inch, for example. The blade may be adapted in specific dimensions to be useful in a variety of applications such as small, hand-held scrapers and multipurpose heavy duty flooring scrapers. The blade may also be modified in material or dimensions as required for use in industries such as paper mills and saw mills where the knife or scraper blade may be used for cutting, chipping, shearing, and shaving. The inventive knife or scraper blade is useful with a variety of materials such a mortars, mastics, adhesives, tile, vinyl, wood, paint, rubber, tar, and plastics.

The inventive knife or scraper blade may be constructed from any appropriate material, such as hard treated steel. The blade may also be of flat steel extending from the front edge to the shank and the skirts may be of an appropriate hard plastic material which adheres to the steel blade or is attached by an adhesive.

It is to be understood that the present invention is not limited to the embodiment described above, but encompasses any and all embodiments within the scope of the following claims.

I claim:

1. A floor scraper apparatus comprising;

a blade holding body;

a handle extending from said body;

said body having a blade gripper;

said blade gripper having a nose portion for receiving a scraper blade; and a scraper blade having an upper side, a lower side, a front edge and a rear shank comprising:

a beveled edge portion;

a skirt portion;

a flat portion extending between said beveled edge portion and said skirt portion;

said skirt portion having at least one upper skirt extending upward from said flat portion and an identical lower skirt extending downward from said flat portion; and a shank portion extending from said skirt portion;

whereby as said scraper is urged forward, dislodged or cut material travels over said beveled edge portion and said skirt portion and is deflected by said skirt portion away from said shank portion and over said nose portion of said gripper.

2. The floor scraper apparatus of claim 1, wherein each said skirt of said blade is generally wedge shaped, said upper skirt extending upward from said flat portion to an upper extreme and having a generally vertical rear wall extending from its upper extreme to said shank portion, and said lower skirt extending upward from said flat portion to an upper extreme and having a generally vertical rear wall extending from its upper extreme to said shank portion.

3. The floor scraper apparatus of claim 2, wherein each said skirt of said blade is concave in shape.

4. The floor scraper apparatus of claims 3, wherein said skirt forms a radius.

5. The floor scraper apparatus of claim 2, wherein said flat portion and said shank portion of said blade are equal in thickness.

6. The floor scraper apparatus of claim 5, wherein said flat portion and said shank portion of said blade are about 1/16 inch in thickness and the distance between the upper extreme of said upper skirt and the lower extreme of said lower skirt is about 1/8 inch.

7. The floor scraper apparatus of claim 6, wherein said beveled edge portion is about ⅛ inch in width, said flat portion is about ⅛ inch in width, said skirt portion is about ⅛ inch in width, and said shank portion is about ¼ inch in width, said blade totaling about ⅝ inch in width.

8. The floor scraper apparatus of claim 7, wherein said blade is of constant cross section and about 4 inches in length.

9. A generally planar knife or scraper blade having an upper side, a lower side, a front edge and, a rear shank comprising:

a beveled edge portion;

a skirt portion;

a flat portion extending between said beveled edge portion and said skirt portion;

said skirt portion having at least one upper skirt extending upward from said flat portion and an identical lower skirt extending downward from said flat portion; and a shank portion extending from said skirt portion;

whereby, as said blade is urged forward, dislodged or cut material travels over said beveled edge portion and said skirt portion and is deflected by said skirt portion away from said shank portion.

10. The knife or scraper blade of claim 9, wherein each said skirt is generally wedge shaped, said upper skirt extending upward from said flat portion to an upper extreme and having a generally vertical rear wall extending from its upper extreme to said shank portion, and said lower skirt extending downward from said flat portion to a lower extreme and having a generally vertical rear wall extending from its lower extreme to said shank portion.

11. The knife or scraper blade of claim 10, wherein each said skirt is concave in shape.

12. The knife or scraper blade of, claim 11, wherein said each said skirt forms a radius.

13. The knife or scraper blade of claim 10, wherein said flat portion and said shank portion are equal in thickness.

14. The knife or scraper blade of claim 13, wherein said flat portion and said shank portion are about 1/16 inch in thickness and the distance between the upper extreme of said upper skirt and the lower extreme of said lower skirt is about ⅛ inch.

15. The knife or scraper blade of claim 14, wherein said beveled edge portion is about ⅛ inch in width, said flat portion is about ⅛ inch in width, said skirt portion is about ⅛ inch in width, and said shank portion is about ¼ inch in width, said blade totaling about ⅝ inch in width.

16. The knife or scraper blade of claim 15, wherein said blade is of constant cross section and about 4 inches in length.

* * * * *